US008764395B2

(12) United States Patent
Wilhelm et al.

(10) Patent No.: US 8,764,395 B2
(45) Date of Patent: Jul. 1, 2014

(54) BLADE FOR A GAS TURBINE

(75) Inventors: Thomas Wilhelm, Zurich (CH); Caroline Marchmont, Kirchdorf (CH); Sergei Riazantsev, Nussbaumen (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 13/071,219

(22) Filed: Mar. 24, 2011

(65) Prior Publication Data

US 2011/0223036 A1 Sep. 15, 2011

Related U.S. Application Data

(63) Continuation of application No. PCT/EP2009/062090, filed on Sep. 18, 2009.

(30) Foreign Application Priority Data

Sep. 25, 2008 (CH) ..... 1519/08

(51) Int. Cl.
*F01D 5/18* (2006.01)

(52) U.S. Cl.
USPC ..... 416/97 R

(58) Field of Classification Search
USPC ..... 416/189, 191, 192, 193 A, 194, 195, 248
See application file for complete search history.

(56) References Cited

U.S. PATENT DOCUMENTS

| | | | | |
|---|---|---|---|---|
| 4,576,008 | A | 3/1986 | Silvestri, Jr. | |
| 5,460,486 | A * | 10/1995 | Evans et al. | 416/97 R |
| 5,482,435 | A * | 1/1996 | Dorris et al. | 416/97 R |
| 6,019,572 | A | 2/2000 | Cunha | |
| 6,413,045 | B1 * | 7/2002 | Dancer et al. | 415/173.6 |
| 6,471,480 | B1 * | 10/2002 | Balkcum et al. | 416/97 R |
| 2001/0048878 | A1 | 12/2001 | Willett et al. | |
| 2007/0071593 | A1 | 3/2007 | Rathmann | |

FOREIGN PATENT DOCUMENTS

| | | | |
|---|---|---|---|
| DE | 10227709 | A1 | 2/2003 |
| DE | 102008029941 | A1 | 5/2009 |
| EP | 1041247 | A2 | 10/2000 |

(Continued)

OTHER PUBLICATIONS

International Search Report (PCT/ISA/210) issued on Dec. 12, 2009, by European Patent Office as the International Searching Authority for International Application No. PCT/EP2009/062090 with English translation of category of cited documents.
European Search Report issued on Dec. 30, 2010, Application No. 10154526.7-2321.

(Continued)

*Primary Examiner* — Edward Look
*Assistant Examiner* — Jesse Prager
(74) *Attorney, Agent, or Firm* — Buchanan Ingersoll Rooney PC

(57) ABSTRACT

The blade for a gas turbine includes a blade airfoil having a leading edge and a trailing edge and extending in the blade longitudinal direction up to a blade tip, and at the blade tip the blade airfoil merges into a shroud segment, wherein on the shroud segment a first rib, projecting upwards, is arranged in the flow direction, extending transversely to the flow direction, and upstream of the first rib, in the region of the leading edge of the blade airfoil, a winglet is formed on the shroud segment for guiding of the hot gas flow in this region. With such a blade, a longer service life is achieved by provision being made for direct cooling of the winglet.

12 Claims, 2 Drawing Sheets

(56) References Cited

FOREIGN PATENT DOCUMENTS

| | | | |
|---|---|---|---|
| EP | 1591626 | A1 | 11/2005 |
| GB | 791751 | A | 3/1958 |
| GB | 2298246 | A | 8/1996 |
| GB | 2434842 | A | 8/2007 |
| GB | 2453849 | A | 4/2009 |

OTHER PUBLICATIONS

Siemens AG 2008, "Thermische Isolierung des Umleitventils im Kondensationsbetrieb einer 700° C.—Dampfturbine", File 2008J16020.doc, pp. 1-2.

* cited by examiner

BLADE FOR A GAS TURBINE

RELATED APPLICATION

This application claims priority as a continuation application under 35 U.S.C. §120 to PCT/EP2009/062090, which was filed as an International Application on Sep. 18, 2009 designating the U.S., and which claims priority to Swiss Application 01519/08 filed in Switzerland on Sep. 25, 2008. The entire contents of these applications are hereby incorporated by reference in their entireties.

FIELD

The present disclosure relates to the field of gas turbines and to a blade for a gas turbine.

BACKGROUND INFORMATION

The rotor blades of gas turbines, which are fastened on the rotor and exposed to the hot gas flow in the turbine, can be equipped with a shroud segment on the blade tip, which together with shroud segments of other blades of a blade row, form an annular shroud which lies concentrically to a rotor axis. As a result of the shroud, the blade row can be mechanically stabilized and a secondary flow of hot gas across the blade tip can be reduced. Therefore, aerodynamic efficiency can be increased. Such shroud segments and methods and devices for their cooling are disclosed in, for example, EP-A2-1 041 247, EP-A1-1 591 626 and GB-A-2 434 842.

Some of these shroud segments can be equipped with widened portions of a segment base in front of a first rib on a leading edge of a blade airfoil. This widened portion can be referred to as a "winglet." Such a blade is reproduced in FIG. 1. The blade 10 of FIG. 1 includes a blade airfoil 11, which extends in a blade longitudinal direction (corresponding to the radial direction on the rotor), having a leading edge 13 and a trailing edge 12. The blade airfoil 11 terminates in a blade tip 14 and at the blade tip 14 merges into a shroud segment 16. On the upper side of the flat shroud segment 16, there are two ribs 17 and 18 which, projecting upwards, extend transversely to the flow direction of the hot gas flow 21 and together with the corresponding ribs of the other blades of a blade row form an encompassing ring in each case.

In front of the first rib 18 in the flow direction, the base of the shroud segment 16 extends forwards (upstream), forming a winglet 19 which lies in the region of the leading edge 13 of the blade airfoil 11 and towards the front is delimited by a slightly rounded leading edge 24.

The winglet 19 can prevent hot gas penetrating directly across the first rib 18 into the cavity above the shroud which is formed between the two ribs 17 and 18. Because the winglet 19 projects directly into the hot gas flow 21, it can be exposed to high temperatures. As a result of this, the material properties deteriorate and high thermal stresses occur on the winglet 19, for example, on account of the mismatch in the metal temperatures between the uncooled winglet 19 and the cooled main volume of the shroud segment 16.

Attempts have been made to reduce the temperature on the winglet by a substantial cooling air mass flow being injected into the hot gas flow 21 in the region of the blade tip 14 in order to locally reduce the temperature of the flowing medium around the winglet. This very indirect cooling, however, is effective to only a limited degree, is difficult to meter and, as a result of the comparatively large injected cooling air mass flow, impairs the efficiency of the system.

SUMMARY

A blade for a gas turbine according to the disclosure, comprises: a blade airfoil having a leading edge and a trailing edge extending in a blade longitudinal direction up to a blade tip, and at the blade tip the blade airfoil merges into a shroud segment; a first rib, projecting upwards, arranged on the shroud segment in the flow direction, extending transversely to said flow direction; a winglet formed on the shroud segment upstream of the first rib, in a region of the leading edge of the blade airfoil, for guiding a hot gas flow in this region; and means for direct cooling of the winglet.

BRIEF DESCRIPTION OF THE DRAWINGS

The disclosure shall subsequently be explained in more detail based on exemplary embodiments in conjunction with the drawings. All elements which are not essential for the direct understanding of the disclosure have been omitted. Like elements are provided with the same designations in the various figures. In the drawings.

DETAILED DESCRIPTION

A blade, equipped with a winglet, is disclosed for a gas turbine, which can provide a cooling of the winglet which is effective, highly efficient, and can limit impairment of efficiency.

The disclosure provides for direct cooling of the winglet. As a result of this, the thermal stresses on the shroud segment in the region of the leading edge of the blade can be reduced without an excessive amount of cooling fluid having to be blown into the hot gas flow.

According to an exemplary embodiment of the disclosure, the direct cooling of the winglet can be accomplished by a multiplicity of cooling holes which extend inside the winglet. As a result of the cooling holes, a directed cooling of all the vital regions of the winglet can be enabled with at the same time intensive contact between cooling medium and winglet and minimum use of cooling medium. For example, the winglet has a leading edge which faces the hot gas flow, and the cooling holes are led up to the leading edge of the winglet.

According to another exemplary embodiment of the disclosure the cooling holes can be arranged obliquely to the flow direction of the hot gas flow. For example, the cooling holes can be guided past the leading edge of the blade airfoil on both sides. As a result of this, the thermal gradients can be reduced and the holes do not terminate close to or directly on the leading edge which can be mechanically highly stressed.

The cooling holes in this case can be in communication with the interior of the blade airfoil for the supply with a cooling medium, especially cooling air.

Figure 1:
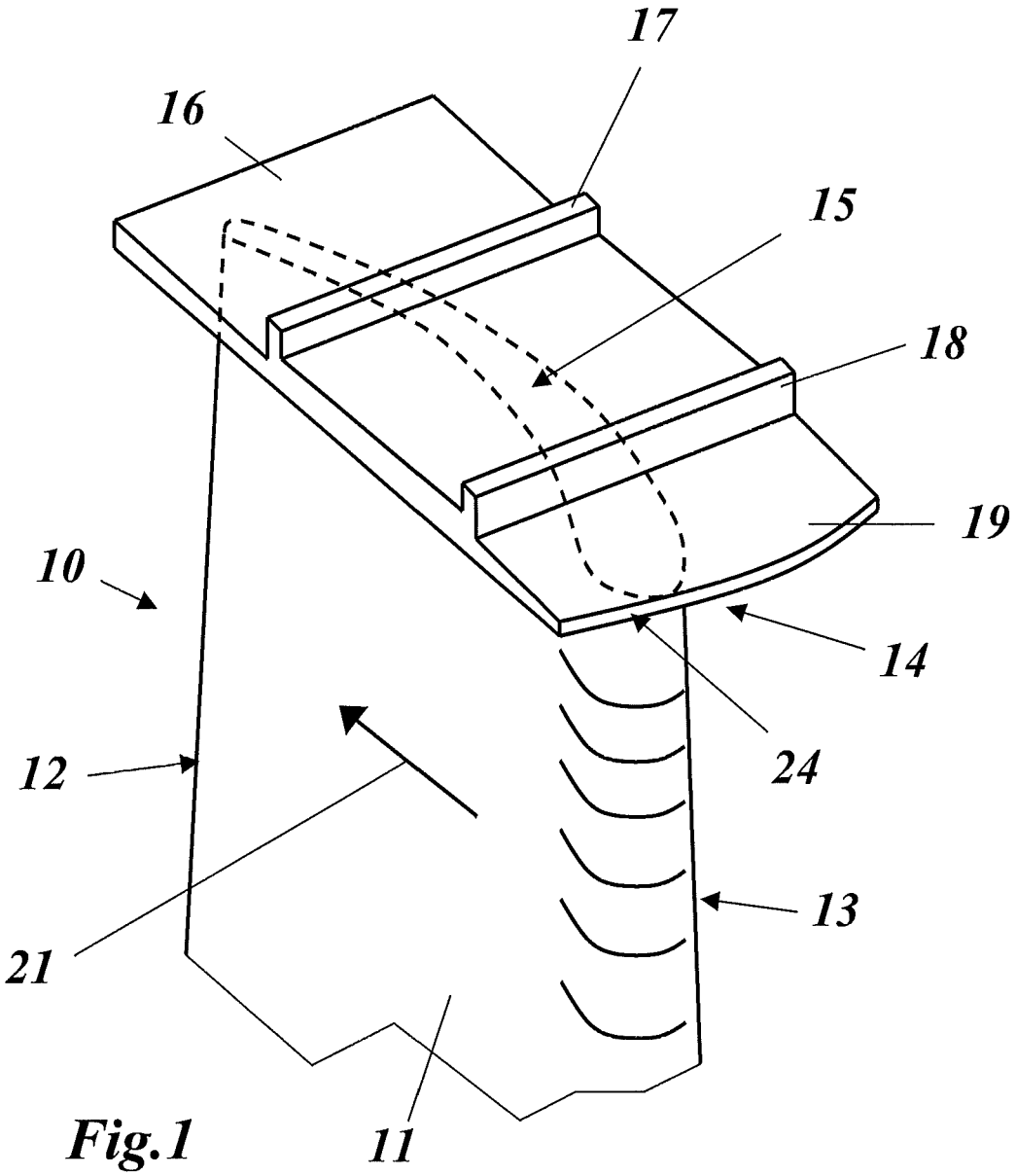
FIG. 1 shows in a perspective side view the upper part of a schematically represented gas turbine blade with shroud segment and winglet attached on the shroud segment, according to an exemplary embodiment.
Figure 2:
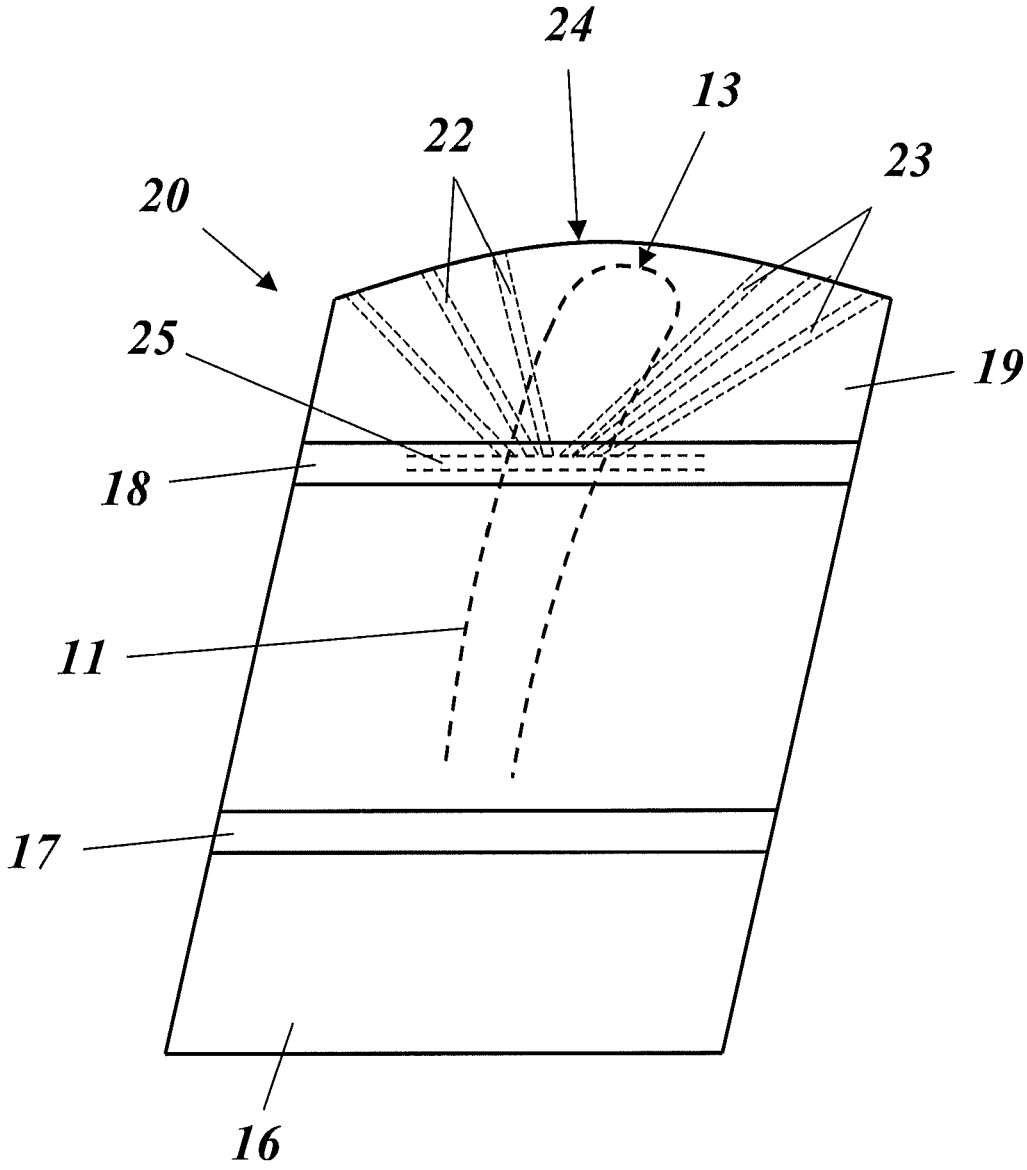
FIG. 2 shows in plan view from above the arrangement of the cooling holes in the winglet in a blade of the type shown in FIG. 1 according to an exemplary embodiment.

According to an exemplary embodiment of the disclosure, the winglet can be directly cooled on the front side of a shroud segment of a gas turbine blade by cooling holes 22, 23 being run in the winglet according to FIG. 2, through which cooling holes flows a cooling medium, especially cooling air, and efficiently cools the winglet 19 from the inside outwards. The obliquely arranged cooling holes 22, 23 are supplied with cooling medium, for example, via a cooling passage 25, which is arranged beneath the first rib 18, the cooling medium being introduced via the hollow interior 15 of the blade airfoil 11. Exemplary advantages of such cooling according to exemplary embodiment of the disclosure can be:

(a) With a very low mass flow of cooling medium, a significant reduction of the metal temperature in the winglet can be achieved. A cooling medium for globally washing around the blade tip in the hot gas flow can be saved, as a result of which the output and the efficiency of the gas turbine can be improved;

(b) The reduction of the metal temperature can be carried out by the cooling holes in a directed manner and on account of the arrangement of the holes can be accurately predicted; and (c) The holes, if desired, can subsequently be altered in their arrangement, as a result of which increased flexibility can be achieved.

The arrangement of the cooling holes 22, 23 directly in the winglet 19 basically has a notch effect in an intensively stressed region so that there is the risk of crack development at the holes. This risk, however, can be reduced by the cooling holes 22, 23 being arranged obliquely. The cooling holes can reduce the temperature in the winglet 19 and so improve the situation in the winglet regarding "low cycle fatigue", creep and oxidation. An advantage of the oblique arrangement of the cooling holes instead of a straight arrangement in the winglet 19 on the one hand is that the thermal gradients on account of heat absorption become smaller as a result of the cooling medium. Because, on the other hand, the cooling holes 22, 23 do not open out directly on the leading edge 13 of the blade 20 but in the outer space on both sides of it, a negative influence upon the mechanically highly stressed region of the leading edge 13 can be avoided.

As is to be gathered from FIG. 2, the cooling holes 22, 23 are obliquely guided past the leading edge 13 of the blade airfoil 11 on both sides up to the leading edge 24 of the winglet 19.

As a result of the direct cooling of the winglet outside the immediate region of the blade leading edge 13, the service life of the blade 20 can be improved.

Thus, it will be appreciated by those having ordinary skill in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

10, 20 Blade (gas turbine)
11 Blade airfoil
12 Trailing edge
13 Leading edge
14 Blade tip
15 Interior
16 Shroud segment
17, 18 Rib
19 Winglet
21 Hot gas flow
22, 23 Cooling hole (oblique)
24 Leading edge (winglet)
25 Cooling passage

What is claimed is:

1. A blade for a gas turbine, comprising:

a blade airfoil having a leading edge and a trailing edge extending in a blade longitudinal direction up to a blade tip, and at the blade tip the blade airfoil merges into a shroud segment;

a first rib, projecting upwards, arranged on the shroud segment in a flow direction of a hot gas flow, extending transversely to said flow direction;

a winglet formed on the shroud segment upstream of the first rib, in a region of the leading edge of the blade airfoil, for guiding a hot gas flow in this region; and a plurality of cooling holes which extend inside the winglet for direct cooling of the winglet, wherein the winglet comprises a leading terminal edge for arranging transversely to the flow direction of the hot gas flow wherein the entire leading terminal edge is curved, the plurality of cooling holes being led up to the curved portion of the leading terminal edge of the winglet obliquely, and wherein the cooling holes are in communication with a cooling passage arranged in an interior of the blade airfoil and below a central portion of the first rib for supply with a cooling medium, the cooling holes leading up to the leading terminal edge of the winglet obliquely from the central portion of the first rib only to portions of the winglet on either side of the blade airfoil.

2. The blade as claimed in claim 1, wherein the cooling holes are guided to the leading terminal edge of the winglet so that a plurality of cooling holes are arranged on both sides of the blade airfoil.

3. The blade as claimed in claim 2, wherein the cooling holes are in communication with an interior of the blade airfoil for supply with a cooling medium.

4. The blade as claimed in claim 1, wherein the cooling medium is air.

5. The blade as claimed in claim 3, wherein the cooling medium is air.

6. The blade as claimed in claim 1, in combination with a gas turbine.

7. A blade for a gas turbine, comprising:

a blade airfoil having a leading edge and a trailing edge extending in a blade longitudinal direction up to a blade tip, and at the blade tip the blade airfoil merges into a shroud segment;

a first rib, projecting upwards, arranged on the shroud segment in a flow direction, extending transversely to said flow direction;

a winglet formed on the shroud segment upstream of the first rib, in a region of the leading edge of the blade airfoil, for guiding a hot gas flow in this region, the winglet including a leading terminal edge flow wherein the entire leading terminal edge is arc-shaped; and a plurality of cooling holes which extend inside the winglet for direct cooling of the winglet, wherein the cooling holes are guided to the arc-shaped portion of the leading terminal edge of the winglet so that a plurality of cooling holes are arranged on both sides of the blade airfoil, and wherein the cooling holes are in communication with a cooling passage arranged in an interior of the blade airfoil and below a central portion of the first rib for supply with a cooling medium, the cooling holes leading up to the leading terminal edge of the winglet obliquely from the central portion of the first rib only to portions of the winglet on either side of the blade airfoil.

8. The blade as claimed in claim 7, wherein the cooling holes are arranged obliquely to the flow direction of the hot gas flow.

9. The blade as claimed in claim 7, wherein the cooling holes are in communication with an interior of the blade airfoil for supply with a cooling medium.

10. The blade as claimed in claim 7, wherein the cooling medium is air.

11. The blade as claimed in claim 8, wherein the cooling medium is air.

12. The blade as claimed in claim 7, in combination with a gas turbine.

* * * * *